US012297544B2

(12) United States Patent
Sohn et al.

(10) Patent No.: US 12,297,544 B2
(45) Date of Patent: May 13, 2025

(54) HOT PRESS FORMED PRODUCT HAVING EXCELLENT CORROSION RESISTANCE AND METHOD FOR PREPARING SAME

(71) Applicant: POSCO CO., LTD, Pohang-si (KR)

(72) Inventors: Il-Ryoung Sohn, Gwangyang-si (KR); Hyeon-Seok Hwang, Gwangyang-si (KR); Jong-Sang Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/468,268

(22) Filed: Sep. 15, 2023

(65) Prior Publication Data

US 2024/0002992 A1 Jan. 4, 2024

Related U.S. Application Data

(62) Division of application No. 16/061,844, filed as application No. PCT/KR2016/014937 on Dec. 20, 2016, now abandoned.

(30) Foreign Application Priority Data

Dec. 22, 2015 (KR) ..... 10-2015-0183502

(51) Int. Cl.
*C23C 2/06* (2006.01)
*B21D 22/02* (2006.01)
(Continued)

(52) U.S. Cl.
CPC ..... *C23C 2/06* (2013.01); *B21D 22/02* (2013.01); *B21D 22/022* (2013.01); *B21D 37/16* (2013.01);
(Continued)

(58) Field of Classification Search
CPC .. C23C 2/026; C23C 2/04; C23C 2/06; C23C 2/12
See application file for complete search history.

(56) References Cited

U.S. PATENT DOCUMENTS 8,721,809 B2 5/2014 Vlot et al.
2006/0234055 A1* 10/2006 Wu ..... C23C 2/026 427/535
(Continued)

FOREIGN PATENT DOCUMENTS

CN 102791901 11/2012
CN 104136650 11/2014
(Continued)

OTHER PUBLICATIONS

Chinese Office Action—Chinese Application No. 201680074460.6 issued on Feb. 11, 2019, citing CN 104136650, CN 102791901, KR 20090055264, CN 104583437 and JP 2005113233.
(Continued)

*Primary Examiner* — Samir Shah
*Assistant Examiner* — Ricardo D Morales
(74) *Attorney, Agent, or Firm* — CANTOR COLBURN LLP

(57) ABSTRACT

Provided is a hot press formed product, which is prepared by means of hot press forming of a Zn—Al—Mg-based plated steel material comprising base iron and a Zn—Al—Mg-based plated layer, and a method for preparing the same, the hot press formed product comprising an oxide layer formed on the surface thereof, wherein the content ratio of Al to Mg (Al/Mg) in the oxide layer is 0.8 or more.

9 Claims, 2 Drawing Sheets

(51) Int. Cl.

| | |
|---|---|
| ***B21D 37/16*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C23C 2/02*** | (2006.01) |
| ***C23C 2/26*** | (2006.01) |
| ***C23C 2/28*** | (2006.01) |

(52) U.S. Cl.

CPC ..... *C21D 8/0226* (2013.01); *C21D 8/0236* (2013.01); *C21D 8/0247* (2013.01); *C21D 8/0278* (2013.01); *C21D 9/46* (2013.01); *C22C 38/00* (2013.01); *C22C 38/02* (2013.01); *C22C 38/04* (2013.01); *C23C 2/02* (2013.01); *C23C 2/022* (2022.08); *C23C 2/261* (2022.08); *C23C 2/29* (2022.08)

(56) References Cited

U.S. PATENT DOCUMENTS

| | | | | |
|---|---|---|---|---|
| 2012/0267012 | A1 | 10/2012 | Sohn et al. | |
| 2014/0363697 | A1* | 12/2014 | Kim | C23C 28/3225 205/152 |
| 2015/0027596 | A1* | 1/2015 | Miyoshi | C22C 38/02 148/533 |
| 2015/0125714 | A1 | 5/2015 | Machado Amorim et al. | |
| 2015/0284819 | A1 | 10/2015 | Tamaki et al. | |
| 2017/0096724 | A1 | 4/2017 | Hikida et al. | |

FOREIGN PATENT DOCUMENTS

| | | |
|---|---|---|
| CN | 104583437 | 4/2015 |
| EP | 2808417 | 12/2014 |
| JP | 0257670 | 2/1990 |
| JP | 07207421 | 8/1995 |
| JP | 2000104154 | 4/2000 |
| JP | 2000160353 | 6/2000 |
| JP | 2000328221 | 11/2000 |
| JP | 2003126920 | 5/2003 |
| JP | 2004270029 | 9/2004 |
| JP | 2005113233 | 4/2005 |
| JP | 2005248320 | 9/2005 |
| JP | 2006097094 | 4/2006 |
| JP | 2006265706 | 10/2006 |
| JP | 4447270 | 4/2010 |
| JP | 2011157576 | 8/2011 |
| JP | 2013515863 | 5/2013 |
| JP | 2013185184 | 9/2013 |
| JP | 2014091130 | 5/2014 |
| JP | 2015521233 | 7/2015 |
| KR | 20090055264 | 6/2009 |
| KR | 20110076146 | 7/2011 |
| KR | 20140029962 | 3/2014 |
| KR | 20150075650 | 7/2015 |
| WO | 2015147216 | 10/2015 |

OTHER PUBLICATIONS

European Search Report—European Application No. 16879298.4 issued on Aug. 17, 2018, citing EP 2 808 417, KR 2011 0076146 and KR 2009 0055264.

International Search Report—PCT/KR2016/014937 dated Mar. 7, 2017.

Japanese Office Action—Japanese Application No. 2018-532217 issued on Jun. 25, 2019, citing JP 2003-126920, WO 2015/147216, JP 2006-265706, JP 2000-328221, JP 2015-521233, JP 2013-515863, JP 2011-157576, JP 2014-91130, JP 2000-104154, JP 2000-160353, JP 2006-97094, JP 2005-248320 and JP 2013-185184.

* cited by examiner

HOT PRESS FORMED PRODUCT HAVING EXCELLENT CORROSION RESISTANCE AND METHOD FOR PREPARING SAME

TECHNICAL FIELD

The present disclosure relates to a hot press formed product having excellent corrosion resistance and a method for preparing the same.

BACKGROUND ART

Recently, high-strength steel is increasingly being utilized for lightening the weight of cars, but such high-strength steel may be easily abraded or fractured when processed at room temperature. In addition, since spring back also occurs at the time of processing, precise dimension processing is difficult, and thus, it is difficult to mold a product having a complicated shape. Accordingly, as a preferable method for processing high-strength steel, hot press forming (HPF) is being applied.

Hot press forming (HPF) is a method of processing steel into a complicated shape at high temperature, using the nature of the steel of being softened and highly ductile at high temperature, and more specifically, steel is subjected to processing, simultaneously with quenching in the state of being heated equal to or higher than the austenite region to transform the structure of steel to martensite, thereby preparing a high-strength product having a precise shape.

However, when heating a steel material to a high temperature, there may be corrosion or decarburization on the surface of the steel material, and in order to prevent this phenomenon, a zinc-based plated steel material having a zinc-based plating layer formed on the surface is currently attracting attention, as a material for hot press forming.

However, in the case of a general zinc-based plated steel material, zinc may be excessively oxidized during heating for hot press forming, so that the effective thickness of the plating layer may be decreased, or the content of zinc in the zinc-based plating layer may be excessively decreased, so that corrosion resistance after forming is deteriorated.

Meanwhile, recently, for further improving the corrosion resistance of the zinc-based plated steel material, there has been suggested a technique to add magnesium to the plating layer. When adding magnesium to the plating layer, a magnesium-based corrosion product is densely formed below the corrosive environment to decrease a corrosion rate, thereby obtaining an effect of improving corrosion resistance. However, this magnesium is rapidly oxidized at high temperature to greatly damage the plating layer, and thus, the addition of magnesium to the zinc-based plated steel material for hot press forming is currently limited.

DISCLOSURE

Technical Problem

An aspect of the present disclosure is to provide a hot press formed product having excellent corrosion resistance and a method for preparing the same.

Technical Solution

According to an aspect of the present disclosure, a hot press formed product is prepared by hot-press forming a Zn—Al—Mg-based plated steel material including base iron and a Zn—Al—Mg-based plating layer, wherein the hot press formed product includes an oxide layer formed on a surface thereof, and the content ratio of Al to Mg (Al/Mg) in the oxide layer is 0.8 or more.

According to another aspect of the present disclosure, a method for preparing a hot press formed product includes immersing base iron in a Zn—Al—Mg-based plating bath and performing plating to obtain a Zn—Al—Mg-based plated steel material; adjusting a plated coating weight of the Zn—Al—Mg-based plated steel material and then performing cooling; heating the cooled Zn—Al—Mg-based plated steel material to a heating temperature of 600-950° C. in a heating furnace; and forming the Zn—Al—Mg-based plated steel material which has reached the heating temperature with a mold simultaneously with quenching, wherein a residence time is 120 seconds or less, the residence time representing a time during which the Zn—Al—Mg-based plated steel material which has reached the heating temperature resides in the heating furnace.

Advantageous Effects

As set forth above, according to an exemplary embodiment in the present disclosure, the hot press formed product prepared according to the present disclosure has very good corrosion resistance.

BEST MODE FOR INVENTION

Figure 1:
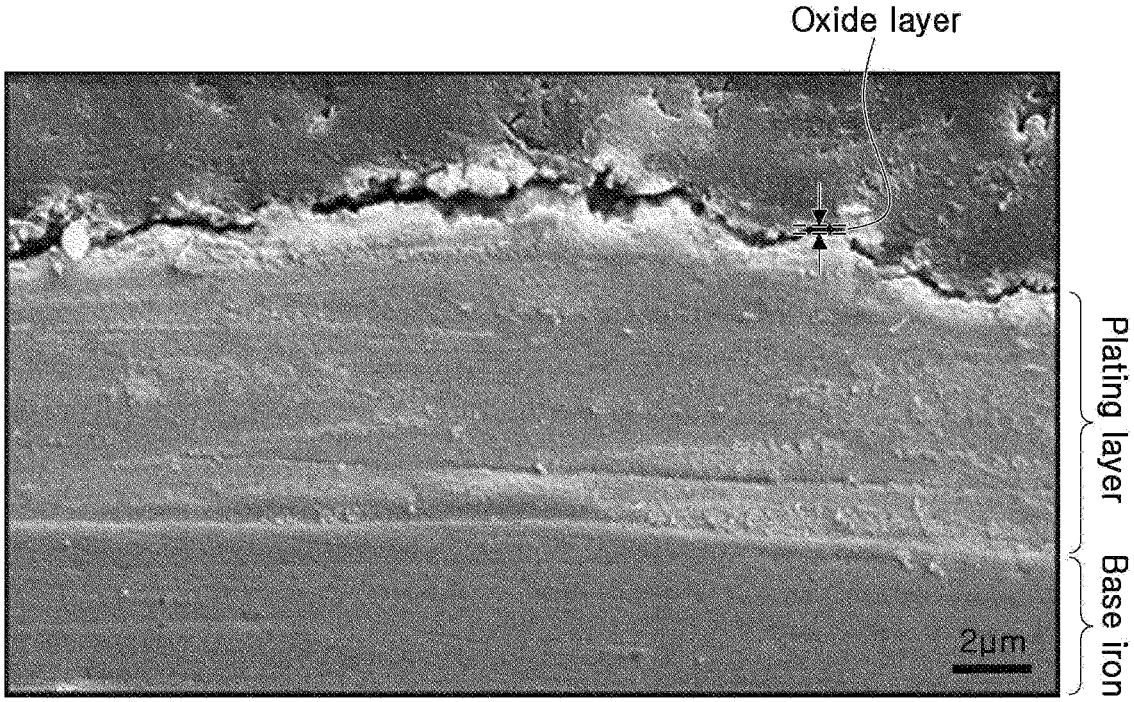
FIG. 1 is a scanning electron microscope (SEM) image observing a section of the hot press formed product according to Inventive Example 5.

Hereinafter, a hot press formed product having excellent corrosion resistance, an aspect of the present disclosure, will be described in detail.

The hot press formed product of the present disclosure is prepared by hot-press forming a Zn—Al—Mg-based plated steel material including base iron and a Zn—Al—Mg-based plating layer. Here, the base iron may be a steel plate or a steel wire rod.

The composition of the base iron is not particularly limited in the present disclosure, however, as an example, it may contain: 0.15-0.35% by weight of C, 0.5% by weight or less (exclusive of 0%) of Si, 0.5-8.0% by weight of Mn, and 0.0020-0.0050% by weight of B, with a balance of Fe and unavoidable impurities.

C: 0.15-0.35% by Weight

Carbon, an element for stabilizing austenite, is added for securing quenching properties, and securing strength of a formed product after hot press forming. When the content of carbon is unduly low, the product may lack quenching properties, resulting in a difficulty in securing the target strength. Accordingly, in the present disclosure, preferably by weight or more, more preferably 0.18% by weight or more of C is contained.

However, when the content of carbon is unduly high, toughness and weldability degradation may be caused, and due to an excessive increase in strength, there may be demerits in the manufacturing process, such as threading hinderance in annealing and plating processes. Accordingly, in the present disclosure, preferably 0.35% by weight or less, more preferably by weight or less of C is contained.

Si: 0.5% by Weight or Less (Exclusive of 0% by Weight)

Silicon is a component added for deoxidation, however, when the content is unduly high, a large amount of $SiO_2$ is produced on the surface of steel at the time of annealing, thereby causing unplating. Accordingly, in the present disclosure, preferably 0.5% by weight or less, more preferably 0.4% by weight or less of Si is contained.

Mn: 0.5-8.0% by Weight

Manganese not only greatly contributes to a strength increase as a solid solution strengthening element, but also plays an important role in delaying transformation from austenite to ferrite. When the content of manganese is unduly low, a transformation temperature (Ae3) from austenite to ferrite is raised, so that an excessively high heat treatment temperature is required for hot press processing in the austenite single phase region. Accordingly, in the present disclosure, preferably 0.5% by weight or more, more preferably 1.0% by weight or more of Mn is contained. However, when the content of manganese is unduly high, weldability, hot rolling properties and the like may be deteriorated. Accordingly, in the present disclosure, preferably 8.0% by weight or less, more preferably 7.8% by weight or less of Mn is contained.

B: 0.0020-0.0050% by Weight

Boron serves to delay transformation from austenite to ferrite. In order to obtain this effect in the present disclosure, preferably 0.0020% by weight or more, more preferably 0.0022% by weight or more of B is contained. However, when the content is excessive, the effect is not only saturated, but also deteriorates hot workability. Accordingly, in the present disclosure, preferably 0.0050% by weight or less, more preferably 0.0045% by weight or less of B is contained.

In addition to the above composition, the remaining is Fe. However, since in the common manufacturing process, unintended impurities may be inevitably incorporated from raw materials or the surrounding environment, they may not be excluded. Since these impurities are known to any person with ordinary knowledge in the art, the entire contents thereof are not particularly mentioned in the present specification.

However, as a representative example of these impurities, Al, P and S may be mentioned, and when the content of Al in the base iron is increased, steelmaking cracks may be caused, and thus, it is preferable to adjust the content of Al to 0.2% by weight or less, and when the contents of P and S are increased, ductility may be deteriorated, and thus, it is preferable to adjust the contents of P and S to 0.03% by weight or less, and 0.001% by weight or less, respectively.

The Zn—Al—Mg-based plating layer is formed on the surface of base iron to serve to prevent the corrosion of the iron base under the corrosive environment, and may contain: 0.9-3.5% by weight of Mg, and 1.0-15% by weight of Al, with a balance of Zn and other unavoidable impurities.

Mg is an essential element, added for improving the corrosion resistance of a hot press formed product, and forms a dense corrosive product on the surface of plating layer, thereby effectively preventing the corrosion of the hot press formed product. Meanwhile, Mg in the Zn—Al—Mg-based plating layer is partially oxidized and lost in the course of hot pressing, and the Zn—Al—Mg-based plating layer is alloyed with Fe to decrease the content of Mg in the entire plating layer, and thus, in order to secure the corrosion resistance equivalent to a common plated steel material, a larger amount of Mg may be contained. In order to secure the corrosion resistance effect required in the present disclosure, 0.9% by weight or more, more preferably 0.95% by weight or more of Mg should be contained. However, when the content is excessive, oxidation of Mg on the surface of the plating bath becomes significant so that plating workability is deteriorated, and also excessive MgO is formed in the course of hot pressing to promote the oxidation and volatilization of Zn, thereby deteriorating the corrosion resistance of the hot press formed product. In terms of preventing this, 3.5% by weight or less, more preferably 3.3% by weight or less of Mg should be contained.

Al forms a stable $Al_2O_3$ layer on the surface in the course of hot pressing to suppress the oxidation and volatilization of Zn, thereby contributing the improvement of corrosion resistance of the hot press formed product. In order to obtain this effect in the present disclosure, 1.0% by weight or more, more preferably 1.1% by weight or more of Al should be contained. However, when the content is excessive, the thermal resistance of the surface may become better, but the melting temperature of the plating bath is unduly raised at the time of hot-dip coating, causing a difficulty in operation. In terms of preventing this, 15% by weight or less of Al should be contained.

The hot press formed product of the present disclosure includes an oxide layer formed on the surface, and it is characterized in that the content ratio of Al to Mg (Al/Mg) in the oxide layer is 0.8 or more. The content ratio is preferably in a range of 0.85 or more, more preferably 0.9 or more.

As a result of research of the present inventors, the Mg-based oxide coat is not physically stable, and thus, it is easily broken to promote the oxidation and volatilization of Zn in the plating layer. However, the Al-based oxide coat is physically very stable, and thus, when an Al-based oxide coat is stably produced on the surface, not only the oxidation and volatilization of Zn in the plating layer is prevented, but also the amount of oxide itself is significantly decreased, thereby greatly improving the corrosion resistance of the hot press formed product. In order to obtain this effect in the present disclosure, the content ratio of Al to Mg (Al/Mg) in the oxide layer is needed to be controlled to 0.8 or more.

In the present disclosure, any specific device or method for measuring the contents of Mg and Al in the oxide layer, and the like is not particularly limited; however, for example, it may be measured using GDOES (glow discharge optical emission spectrometry). Herein, it is preferable to analyze the element to be analyzed after calibrating the analysis equipment using a standard specimen.

According to an exemplary embodiment, the total coating weight of Zn, Al and Mg may be 700 $mg/m^2$ or less (exclusive of 0 $mg/m^2$), more preferably 500 $mg/m^2$ or less (exclusive of 0 $mg/m^2$), still more preferably 100 $mg/m^2$ or less (exclusive of 0 $mg/m^2$).

The surface oxide increases surface resistance at the time of spot welding to cause welding spatter, thereby rendering welding to be difficult or impossible, and when the total coating weight of the oxide is 700 $mg/m^2$ or less as described above, excellent weldability may be secured. According to an exemplary embodiment, when performing spot welding according to the relevant procedure such as KS B ISO 15609, in the case that the total coating weight of the oxide as the above is suppressed to 700 $mg/m^2$ or less, a weldable current range of 0.5 KA or more is obtained, however, in the case that the total coating weight of the oxide is above the range, the weldable current range of 0.5 KA or less is obtained, or the weldable current range is not obtainable.

According to an exemplary embodiment, the oxide layer may contain one or two or more selected from the group consisting of Mn, Si and Fe, and the sum of these contents may be 50% or less, more preferably 30% or less, still more preferably 10% or less relative to the total content of metal in the oxide layer. There are concerns that the above elements form physical or chemical defects in the oxide layer to hinder an improvement effect of thermal resistance at high temperature. Accordingly, it is preferable to suppress the content as much as possible.

According to an exemplary embodiment, a ratio ($Mg_O/Mg_C$) of the total amount of Mg ($Mg_O$) contained in the oxide layer of the hot press formed product to the total amount of Mg ($Mg_C$) contained in the plating layer of the hot press formed product may be 1 or less, more preferably 0.5 or less, still more preferably 0.3 or less.

Mg contained in the plating layer greatly contributes to the improvement of the corrosion resistance of the hot press formed product, and thus, for securing excellent corrosion resistance, it is preferable that the oxidation of Mg is suppressed in the course of hot pressing, so that Mg is maintained in the form of being solid solubilized in the plating layer as much as possible. When the total amount ratio ($Mg_O/Mg_C$) is controlled to 1 or less, the corrosion resistance of the hot press formed product may be further significantly increased.

According to an exemplary embodiment, an alloying degree of Fe in the plating layer of the hot press formed product may be 20-70%, more preferably 25-65%, still more preferably 30-60%. When the alloying degree of Fe satisfies the above range, the occurrence of the oxide coat during a heating process may be effectively suppressed, and the corrosion resistance property by a sacrifice way becomes excellent. When the alloying degree of Fe is less than 20%, some regions of the plating layer in which Zn is concentrated are present as a liquid phase, causing liquid embrittlement cracks upon processing. Meanwhile, the alloying degree of Fe is more than 70%, the corrosion resistance may be decreased.

The hot press formed product as described above may be prepared in various ways, and the preparation method thereof is not particularly limited. However, as an exemplary embodiment, it may be prepared by the following method.

Hereinafter, a method for preparing a hot press formed product having excellent corrosion resistance, another aspect of the present disclosure, will be described in detail.

First, base iron is immersed in a Zn—Al—Mg-based plating bath, and plating is performed to obtain a Zn—Al—Mg-based plated steel material. The specific method for obtaining a plated steel material is not particularly limited in the present disclosure, however, in order to further significantly increase the effect of the present disclosure, the following method may be used:

(a) Type of Base Iron and Control of Surface Roughness

According to the research results of the present inventors, the surface roughness of base iron before plating has an influence on the activity of Al in the plating layer, and in particular, lower surface roughness of base iron increase the activity of Al, and thus, is advantageous for stably forming $Al_2O_3$ on the surface of the hot press formed product. In order to obtain this effect in the present disclosure, it is preferable to use a cold rolled steel plate having a surface roughness (Ra) controlled to 2.0 μm or less as the base iron. Meanwhile, since lower surface roughness is advantageous for increasing the activity of Al, the lower limit of the surface roughness is not particularly limited in the present disclosure, however, when the surface roughness of the base iron is unduly low, sliding of a steel material during rolling may interfere with the operation, and thus, for preventing this, the lower limit may be limited to 0.3 μm.

(b) Control of Plating Bath Composition

According to the research results of the present inventors, when Al and Mg are added to the plating bath in combination, the content ratio of Al and Mg also has an influence on the activity of Al, and in particular, a higher Al/Mg ratio increases the activity of Al, and thus, is advantageous for stably forming $Al_2O_3$ on the surface of the hot press formed product. In order to obtain this effect in the present disclosure, it is preferable to control the Al/Mg ratio in the plating bath to 0.8 or more. Meanwhile, since the higher Al/Mg ratio is advantageous for increasing the activity of Al, the lower limit thereof is not particularly limited in the present disclosure.

(c) Formation of Pre-Plating Layer and Control of Annealing Conditions

According to the research results of the present inventors, when base iron contains a large amount of pro-oxidizing elements such as Mn, diffusion of the pro-oxidizing elements into the plating layer significantly occurs, and the diffused pro-oxidizing element into the plating layer as such lowers the activity of Al, thereby interfering with stable formation of an $Al_2O_3$ coat.

In order to prevent this, according to an exemplary embodiment, after pre-plating one or more metals selected from the group consisting of Fe, Ni, Cu, Sn and Sb on the surface, plating may be performed on base iron subjected to annealing. Meanwhile, the method of pre-plating is not particularly limited in the present disclosure, and for example, it may be formed by an electroplating method.

Herein, it is preferable that the thickness of a pre-plating layer is 5-100 nm. When the thickness is less than 5 nm, it is difficult to effectively suppress the diffusion of the pro-oxidizing element into the plating layer, however, when the thickness is more than 100 nm, it may be effective in surface oxide suppression, but securing economical efficiency is difficult.

Meanwhile, an annealing treatment is carried out for recovery of recrystallization of a base iron structure, and may be carried out at a temperature of 750-850° C. at which the recrystallization of the base iron structure is sufficiently recovered.

According to an exemplary embodiment, the annealing treatment may be carried out under an atmosphere of 1-15% by volume of hydrogen gas and remaining nitrogen gas. When the hydrogen gas is less than 1% by volume, it may be difficult to effectively perform the suppression of the surface oxide, however, when the hydrogen gas is more than 20% by volume, the cost is increased due to the increased hydrogen content, and a danger of explosion is also excessively increased.

Next, the Zn—Al—Mg-based plated steel material is heated to a predetermined heating temperature in a heating furnace.

Herein, it is preferable that a residence time representing a time during which the Zn—Al—Mg-based plated steel material which has reached the heating temperature resides in the heating furnace is controlled to 120 seconds or less.

According to the research results of the present inventors, the higher the temperature of the material is, the more active the production of MgO is, and in particular, since Mg is more easily oxidized than other elements, as the material resides at high temperature for a longer time, the oxides by other elements are reduced to increase the ratio of Mg in the oxide layer. In this case, due to the formation of the physically unstable oxide layer, volatilization and oxidization of Zn is promoted, resulting in deterioration of the corrosion resistance of the hot press formed product. Thus, the residence time is controlled to 120 seconds or less in the present disclosure.

Meanwhile, according to further research results of the present inventors, a heating temperature and a heating rate have an influence on the formation of the desired oxide layer.

As a result of research of the present inventors, at the time of heating for hot press forming, an $Al_2O_3$ coat is stably produced initially, and as the heating proceeds, and the temperature of the material is raised, MgO is produced and already produced $Al_2O_3$ is reduced. Thus, in order to prevent the production of MgO and the reduction of $Al_2O_3$, the heating rate is needed to be controlled to be high at 10° C./sec or more.

Meanwhile, when general hot press forming, the heating temperature of the material is 600-950° C., and when the heating temperature is 800° C. or more and 950° C. or less, it is preferable that the heating rate is controlled to be higher at 20° C./sec or more, and at the same time the residence time is controlled to be shorter at 60 seconds or less. The reason why the heating rate is controlled to be higher, and the residence time is controlled to be shorter as such is that the production of MgO is excessive in the high temperature region as described above. Herein, the residence time is controlled to more preferably 40 seconds or less, still more preferably 20 seconds or less, most preferably 15 seconds or less.

The heating rate is significantly high as compared with the case of using a common thermostatic furnace such as an electric furnace, and according to an exemplary embodiment, the heating may be carried out by any one method of radiant heating, high-frequency induction heating and ohmic heating.

The heating is possible even in the atmosphere, but in order to suppress surface oxidation by impurities and promote production of $Al_2O_3$, heating may be performed under the inert gas (e.g., nitrogen, argon, etc.) atmosphere.

Next, the Zn—Al—Mg-based plated steel material which has reached the heating temperature is formed with a mold, simultaneously being quenched, thereby obtaining a hot press formed product.

MODE FOR INVENTION

Hereinafter, the present disclosure will be specifically described through the following Examples. However, it should be noted that the following Examples are only for embodying the present disclosure by illustration, and not intended to limit the right scope of the present disclosure. The reason is that the right scope of the present disclosure is determined by the matters described in the claims and reasonably inferred therefrom.

After preparing a steel material having the composition (% by weight) of the following Table 1, the steel material was processed into a cold rolled steel plate having a thickness of 1.5 mm. Thereafter, the steel material was subjected to annealing heat treatment at a temperature up to 780° C. for 40 seconds under the nitrogen gas atmosphere containing 5% by volume of hydrogen, and immersed in a zinc-based plating bath to obtain a plated steel material. Herein, the temperature of the zinc plating bath was adjusted to constant 450° C.

Thereafter, each plated steel material was heated under the conditions of Table 3, and then formed with a mold simultaneously with being quenched to prepare a formed product.

Thereafter, for each formed product, the tensile strength was measured, corrosion resistance and weldability were evaluated, and the results are shown in the following Table 3. For the corrosion resistance, a salt spray test according to KS R 1127 was used, and after corroding the formed product for 1200 hours and removing the surface corrosion product therefrom, the maximum corrosion depth of a base member was measured. In addition, weldability was evaluated according to KS B ISO 15609, by performing spot welding, and then measuring a weldable current range.

TABLE 1

| Steel type | Base iron components (% by weight) | | | | | | |
|---|---|---|---|---|---|---|---|
| | C | Si | Mn | P | S | Al | B |
| Steel 1 | 0.18 | 0.25 | 1.3 | 0.01 | 0.001 | 0.02 | 0.0025 |
| Steel 2 | 0.2 | 0.3 | 7.5 | 0.02 | 0.003 | 0.1 | 0.0040 |
| Steel 3 | 0.31 | 0.3 | 2.2 | 0.01 | 0.003 | 0.05 | 0.0025 |

TABLE 2

| Plating bath type | Plating bath components (% by weight) | |
|---|---|---|
| | Mg | Al |
| Plating bath 1 | 0.97 | 1.1 |
| Plating bath 2 | 1.41 | 1.43 |
| Plating bath 3 | 1.45 | 15 |
| Plating bath 4 | 3.12 | 2.54 |
| Plating bath 5 | 0 | 0.2 |

TABLE 3

| Classification | Steel type | Plating bath type | Surface roughness (Ra) | Pre-plating | Pre-plated coating weight (mg/m$^2$) | Plating layer thickness (μm) | Heating rate (° C./s) | Heating temperature (° C.) | Residence time (sec) | Press starting temperature (° C.) |
|---|---|---|---|---|---|---|---|---|---|---|
| Inventive Example 1 | Steel 1 | Plating bath 1 | 0.3 | Fe | 150 | 6 | 15 | 880 | 10 | 750 |
| Inventive Example 2 | Steel 1 | Plating bath 2 | 0.9 | — | — | 8 | 20 | 900 | 10 | 750 |
| Inventive Example 3 | Steel 1 | Plating bath 3 | 0.9 | — | — | 8 | 120 | 950 | 10 | 500 |

TABLE 3-continued

| Classi-fication | Steel type | Plating bath type | Surface roughness (Ra) | Pre-plating | Pre-plated coating weight (mg/m$^2$) | Plating layer thickness (μm) | Heating rate (° C./s) | Heating temperature (° C.) | Residence time (sec) | Press starting temperature (° C.) |
|---|---|---|---|---|---|---|---|---|---|---|
| Inventive Example 4 | Steel 1 | Plating bath 4 | 0.9 | — | — | 8 | 15 | 870 | 10 | 750 |
| Inventive Example 5 | Steel 2 | Plating bath 4 | 2.0 | — | — | 4 | 4 | 610 | 120 | 500 |
| Inventive Example 6 | Steel 3 | Plating bath 4 | 1.5 | Fe—Ni | 300 | 5 | 4 | 780 | 10 | 500 |
| Inventive Example 7 | Steel 2 | Plating bath 3 | 1.2 | — | — | 8 | 4 | 700 | 10 | 500 |
| Inventive Example 8 | Steel 2 | Plating bath 4 | 1.2 | — | — | 8 | 30 | 770 | 10 | 500 |
| Inventive Example 9 | Steel 3 | Plating bath 3 | 1.5 | — | — | 8 | 30 | 770 | 10 | 500 |
| Inventive Example 10 | Steel 3 | Plating bath 4 | 1.5 | — | — | 8 | 4 | 770 | 20 | 550 |
| Inventive Example 11 | Steel 3 | Plating bath 4 | 1.5 | Ni | 250 | 8 | 4 | 770 | 20 | 550 |
| Compar-ative Example 1 | Steel 1 | Plating bath 1 | 0.9 | — | — | 8 | 4 | 900 | 180 | 750 |
| Compar-ative Example 2 | Steel 1 | Plating bath 2 | 0.9 | — | — | 8 | 4 | 900 | 300 | 750 |
| Compar-ative Example 3 | Steel 1 | Plating bath 3 | 0.9 | — | — | 8 | 4 | 900 | 300 | 750 |
| Compar-ative Example 4 | Steel 1 | Plating bath 5 | 0.9 | — | — | 8 | 4 | 930 | 300 | 750 |
| Compar-ative Example 5 | Steel 2 | Plating bath 4 | 1.2 | — | — | 8 | 4 | 800 | 300 | 500 |
| Compar-ative Example 6 | Steel 3 | Plating bath 5 | 1.5 | — | — | 8 | 4 | 770 | 300 | 500 |

TABLE 4

| Classification | Al/Mg content ratio in oxide layer | $Mg_O/Mg_C$ | Total coating weight of Zn, Mg and Al (mg/m$^2$) | Tensile strength (Mpa) | Weldable current range (kA) | Maximum corrosion depth (mm)* |
|---|---|---|---|---|---|---|
| Inventive Example 1 | 1.0 | 0.8 | 450 | 1480 | 1.0 | 0.5 |
| Inventive Example 2 | 0.9 | 0.7 | 540 | 1510 | 1.0 | 0.4 |
| Inventive Example 3 | 1.5 | 0.8 | 290 | 1530 | 1.1 | 0.4 |
| Inventive Example 4 | 1.2 | 0.5 | 250 | 1490 | 1.2 | 0.5 |
| Inventive Example 5 | 1.3 | 0.3 | 90 | 1310 | 1.4 | 0.5 |
| Inventive Example 6 | 1.0 | 0.9 | 600 | 1510 | 0.6 | 0.3 |
| Inventive Example 7 | 1.3 | 0.2 | 70 | 1490 | 1.5 | 0.4 |

TABLE 4-continued

| Classification | Al/Mg content ratio in oxide layer | $Mg_O/Mg_C$ | Total coating weight of Zn, Mg and Al ($mg/m^2$) | Tensile strength (Mpa) | Weldable current range (kA) | Maximum corrosion depth (mm)* |
|---|---|---|---|---|---|---|
| Inventive Example 8 | 1.1 | 0.4 | 60 | 1510 | 1.8 | 0.5 |
| Inventive Example 9 | 1.0 | 0.3 | 90 | 1480 | 1.0 | 0.3 |
| Inventive Example 10 | 0.7 | 0.6 | 250 | 1530 | 0.9 | 0.4 |
| Inventive Example 11 | 0.9 | 0.4 | 100 | 1530 | 1.2 | 0.3 |
| Comparative Example 1 | 0.3 | 220 | 1700 | 1550 | 0 | 0.7 |
| Comparative Example 2 | 0.4 | 345 | 2300 | 1520 | 0 | — |
| Comparative Example 3 | 0.4 | 1.5 | 900 | 1490 | 0.2 | — |
| Comparative Example 4 | 0.5 | 300 | 2500 | 1480 | 0 | — |
| Comparative Example 5 | 0.7 | 1.1 | 800 | 1520 | 0.2 | 0.8 |
| Comparative Example 6 | — | — | 1700 | 1510 | 0 | 0.7 |

Referring to Table 4, it is confirmed that Inventive Examples 1 to 11 satisfying all of the conditions proposed in the present disclosure all represented the Al/Mg content ratio in the oxide layer of 0.8 or more, and accordingly, the maximum corrosion depth of a base member after a salt spray test for 1200 hours was 0.5 mm or less, and thus, corrosion resistance was excellent. In addition, it is confirmed that the weldable current range was 0.5 kA or more, and thus, weldability was excellent.

In Table 4, no description for Mgo/Mgc means that there was no Mg in the plating bath like plating bath 5, or Mg in the base iron was all consumed and did not remain. In addition, no description for maximum corrosion depth means that penetration corrosion occurred through a specimen thickness so that the corrosion depth was not able to be measured.

Figure 2:
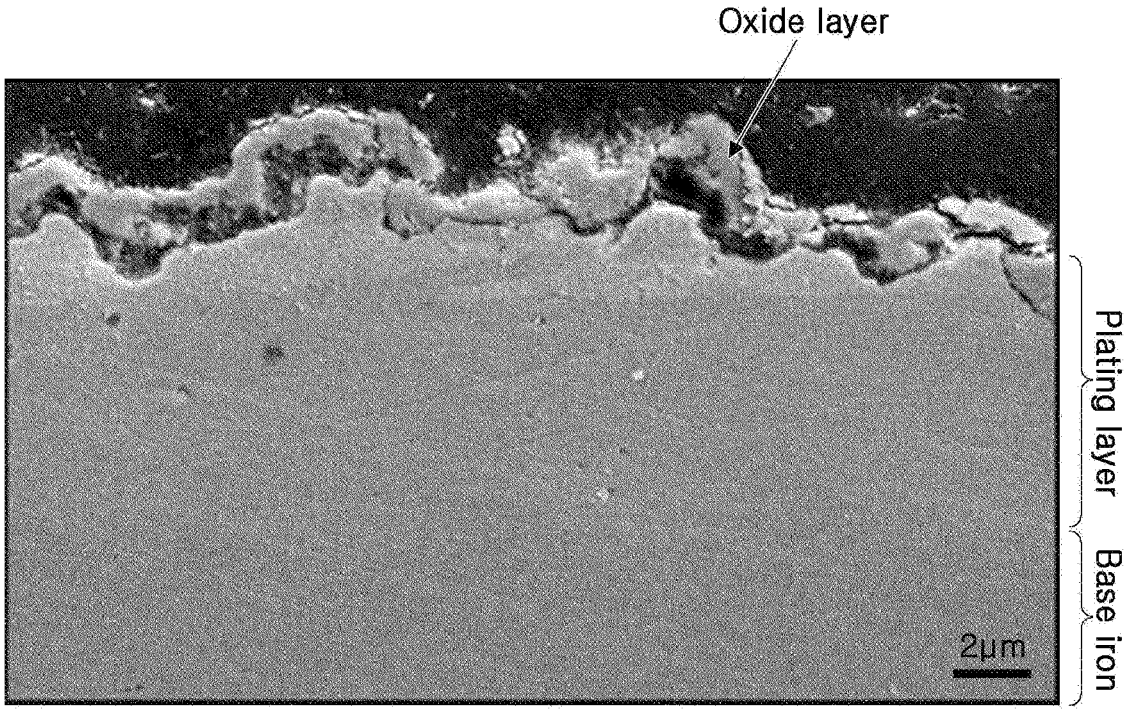
FIG. 2 is a SEM image observing a section of the hot press formed product according to Comparative Example 5.

Meanwhile, FIG. 1 is a scanning electron microscope (SEM) image observing a section of the hot press formed product according to Inventive Example 5. FIG. 2 is a SEM image observing a section of the hot press formed product according to Comparative Example 5.

The invention claimed is:

1. A hot press formed product comprising:

a base iron;

a first plating region formed on the base iron, the first plating region comprising at least one of Fe, Ni, Cu, Sn and Sb, wherein a thickness of the first plating region is 100 nm or less;

a second plating region formed on the first plating region, the second plating region being a Zn—Al—Mg based region comprising: 0.9-3.5% by weight of Mg; 1.0-15% by weight of Al; and a balance of Zn and other unavoidable impurities; and an oxide region formed on the second plating region and comprising Zn, Al and Mg, wherein a content ratio of Al to Mg in the oxide region is 0.8 or more, and a ratio of a total amount of Mg contained in the oxide region to a total amount of Mg contained in the second plating region is 0.9 or less.

2. The hot press formed product of claim 1, wherein the content ratio of Al to Mg is 0.9 or more.

3. The hot press formed product of claim 1, wherein a total weight of the oxide region is 700 $mg/m^2$ or less (exclusive of 0 $mg/m^2$).

4. The hot press formed product of claim 1, wherein the oxide region contains at least one selected from the group consisting of Mn, Si and Fe, and a sum of contents of Mn, Si and Fe in the oxide region is 50% or less relative to a total contents of metals in the oxide region.

5. The hot press formed product of claim 1, wherein the ratio of a total amount of Mg contained in the oxide region to a total amount of Mg contained in the second plating region is 0.5 or less or 0.3 or less.

6. The hot press formed product of claim 1, wherein an alloying degree of Fe in the second plating region is 20-70%.

7. The hot press formed product of claim 1, wherein the base iron contains: 0.15-0.35% by weight of C, 0.5% by weight or less (exclusive of 0% by weight) of Si, 0.5-8.0% by weight of Mn, 0.0020-0.0050% by weight of B, and a balance of Fe and unavoidable impurities.

8. The hot press formed product of claim 1, wherein the hot press formed product has a maximum corrosion depth of 0.5 mm or less when measured after a salt spray test for 1200 hours according to KS R 1127.

9. The hot press formed product of claim 1, wherein the hot press formed product has a tensile strength of 1300 MPa or more.

* * * * *